United States Patent [19]

Tröger et al.

[11] Patent Number: 4,842,763

[45] Date of Patent: Jun. 27, 1989

[54] LIQUID CLEANING SUSPENSION

[75] Inventors: Wolfgang Tröger, Pulheim/Stommelh; Otto Mesmer, Neuss, both of Fed. Rep. of Germany

[73] Assignee: Vorwerk & Co. Interholding GmbH, Wuppertal, Fed. Rep. of Germany

[21] Appl. No.: 943,763

[22] Filed: Dec. 19, 1986

[30] Foreign Application Priority Data

Dec. 20, 1985 [DE] Fed. Rep. of Germany ..... 3545288

[51] Int. Cl.[4] ..... C11D 3/12; C11D 3/26

[52] U.S. Cl. ..... 252/155; 252/89.1; 252/140; 252/153; 252/173; 252/174.24; 252/174.15; 252/DIG. 2; 252/DIG. 10; 134/21

[58] Field of Search ..... 252/88, 174.25, 544, 252/153, 154, 155, DIG. 14, DIG. 15, DIG. 10, 174.24

[56] References Cited

U.S. PATENT DOCUMENTS 4,551,481 11/1985 Smith ..... 252/174

4,561,992 12/1985 Troger, et al. ..... 252/174.25

4,655,952 4/1987 Mesmer et al. ..... 252/91

*Primary Examiner*—A. Lionel Clingman

*Assistant Examiner*—John F. McNally

*Attorney, Agent, or Firm*—Walter Ottesen

[57] ABSTRACT

The invention relates to a liquid cleaning suspension based on a mixture of water, tensides, carrier materials (based on sodium aluminum silicate and urea formaldehyde resin foam), low-molecular weight alcohols, thickeners, and other additives such as fragrances and process materials, antimicrobials or bactericides and further low vapor pressure organic solvents for cleaning smooth vertical surfaces, in particular glass surfaces. The present suspension affords good adhesion, non-dusty application as well as easy removal after cleaning without leaving residues or streaks. The cleaning suspension of the invention comprises from about 5 to 40% by weight of sodium aluminum silicate having a particle size up to 100μ, from about 0.1 to 15% by weight of a pulverized urea formaldehyde foam having a particle size up to 110μ, from about 2 to 50% by weight of a low-molecular weight alcohol, from about 1 to 20% by weight of a high vapor pressure organic solvent, from about 0.5 to 15% by weight of an anionic or non-ionic tenside, from about 10 to 60% by weight of a liquid carrier, preferably water, and from about 0.1 to 10% by weight of a thickener previously dissolved in water, preferably a starch derivative. The suspension may further comprise fragrances, antimicrobial agents, preservatives and process materials.

27 Claims, No Drawings

LIQUID CLEANING SUSPENSION

FIELD OF THE INVENTION

The invention relates to a liquid cleaning suspension based on a mixture of water, tensides, carrier materials such as those based on sodium aluminum silicates and a urea formaldehyde resin foam, low-molecular weight alcohols, thickeners, and other additives such as antimicrobials, stabilizers, fragrances, process materials and other solvents with low vapor pressure. The composition of matter of the invention is useful for cleaning smooth vertical surfaces.

BACKGROUND OF THE INVENTION

Cleaning agents of this type have been known for a number of years.

Suspensions containing solids have, for example, been described in British Pat. No. 1,172,479 and U.S. Pat. No. 3,681,122. These suspensions have been used in particular for washing glass and ceramic surfaces. However, these fluids simply contain an abrasive in suspension and the cleaning agents must be washed off with water after cleaning. Accordingly, the prior art operation is a conventional cleaning operation.

A cleaning agent for upholstery fabrics was also disclosed in European Pat. No. 0086968 comprising a coarse carrier material and a fine adhesive material.

British Pat. No. 1,172,479 and U.S. Pat. No. 3,681,122 relate solely to a scouring agent in a suspension. This scouring agent works according to a conventional "scouring effect" and is also to be washed off with water after cleaning is completed.

European Pat. No. 0086968 relates solely to a textile cleaning agent. This textile cleaning agent adheres only to a very limited extent when applied to a smooth vertical surface. This agent has the added drawback that it leaves a powder or residue when applied onto horizontal surfaces.

SUMMARY OF THE INVENTION

It is an object of the invention to provide a liquid cleaning agent, particularly for cleaning smooth vertically-disposed surfaces such as glass, that avoids the above disadvantages. The cleaning agent of the invention is applied in a manner such that the cleaning agent and in particular the carrier material contained therein adhere well when applied to a surface without forming a powder and is easily removed after cleaning without leaving a residue or streaks on the surface.

The cleaning of smooth vertical surfaces with the cleaning suspension of the invention, especially glass, can be done regardless of the degree of skill of the user. In particular, cleaning can be performed without an otherwise necessary contact of the cleaning material with the skin. A further particular advantage provided by the present cleaning suspension is that cleaning can be done without the aid of water, cloths and other elements otherwise required and that smears and streaks may be avoided.

DESCRIPTION OF A PREFERRED EMBODIMENT OF THE INVENTION

The preferred embodiment of the invention is a homogeneous suspension, white in color, which is substantially stable upon storage, and which can be prepared by mixing the individual components.

The following order is suitably adhered to for the addition of the components in the stated amounts to prepare the liquid cleaning suspension of the invention. The novel composition comprises:

- between about 10 and 60% by weight of a liquid carrier such as water,
- between about 0.5 and 15% by weight of an anionic or non-ionic surfactant such as an alkyl sulfonate,
- between about 2 and 50% by weight of a low molecular weight alcohol,
- between about 5 and 40% by weight of a sodium aluminum silicate having a particle size of up to about and including 110μ,
- between about 0.1 and 15% by weight of a pulverized urea-formaldehyde resin foam having a particle size up to about and including 110μ;
- between about 0.1 and 10% by weight of a thickener such as a starch derivative with water added, and optionally:

- between about 1 and 20% by weight of an organic solvent having high vapor pressure,
- between 0.01 and 5% by weight of a fragrance,
- between about 0.01 and 10% by weight of an antimicrobial or preservative agent, and,
- between about 0.1 and 5% by weight of a process material.

Suitable for use in the present invention are all surfactants known and used in the art. Particularly well suited for this purpose are alkyl sulfonates and among the alkyl sulfonates particularly useful is anionic lithium lauryl sulfonate.

Suitable thickeners for use in the invention are, for example, polysaccharide and derivatives thereof. One preferred group among the polysaccharides are high-molecular weight saccharides. Another preferred group of polysaccharides are starch and derivatives thereof.

Suitable starch derivatives are anionic starch derivatives, and among these, still more preferred are phosphate starch derivatives such as phosphate-wax cornstarch (cross-linked, cured).

Suitable low-molecular weight alcohols are linear or branched aliphatic, alicyclic and aromatic alcohols having 1 to 5 carbon atoms.

A preferred suitable carrier for the invention is water.

Any fragrance can be incorporated into the present composition. Preferred are those possessing a good solvent odor masking capability. A particularly useful fragrance is that known as KOBANJA which is a product of Dragoco, Holzminden, Federal Republic of Germany This fragrance contains up to about 300 individual components.

A more preferred embodiment of the invention encompasses specifically narrow ranges of particle sizes for the formaldehyde-urea foam and the sodium aluminum silicates. A suitable preferred range is up to and including 110μ for both components. The lower limit for the particle sizes of these two components can be as small as they are suitably produced and available.

With a cleaning agent according to the invention, it is possible to effortlessly and thoroughly clean a smooth vertical surface, especially window panes. More particularly, the cleaning agent of the invention is particularly suited for cleaning vertical surfaces due to its capacity to adhere to the surface to be cleaned as it dries in situ.

To this end, the emulsion according to the invention is applied in a defined manner with a suitable apparatus such as a motor-driven spraying device to the glass surface to be cleaned. During this application process, a cleaning movement operating relative thereto takes place which puts the cleaning agent according to the invention into substantial contact with the dirt on the smooth vertical surface being cleaned.

After the application step, a so-called drying step follows, in which the volatile cleaning agents, such as the water and the low-molecular alcohol, evaporate and leave behind a white, dry film on the window surface.

To shorten the period of time of the drying step, which according to the example provided below is approximately 10 minutes, further organic solvents with a suitably high vapor pressure, such as acetone, can be added to the compositon.

High vapor pressure solvents suitable for addition to the inventive suspension can be added in an amount between about 1 and 20% by weight. By high vapor pressure it is understood a vapor pressure, higher than that of water.

Among the high vapor pressure solvents which can be used in this invention are hydrocarbons and derivatives thereof which may further have oxygen, nitrogen and halogen substituents thereof. Of particular use among the former are gasolines and among the latter are chlorinated hydrocarbons.

The ratio of water to alcohol plus solvent determines the drying time required for a particular mixture according to the invention. In contrast, the ratio of water plus alcohol to the thickener determines the adhesion to smooth surfaces.

A suitable water:alcohol plus high vapor pressure organic solvent is between about 10:2 and 60:50.

A suitable water plus alcohol:thickener ratio is between about 12:0.1 and 11:1.

When a high vapor pressure organic solvent is added, the amount of low molecular weight alcohol can be reduced in accordance with the desired drying speed.

The liquid cleaning suspension of the invention may contain in addition to the above-described components:

between about 0.01 and 10% by weight of an antimicrobial agent, and/or between about 0.01 and 2% by weight of a preservative.

Particularly suited for use as antimicrobials and preservatives in the context of the invention are formaldehyde, compounds capable of generating formaldehyde in solution and quaternary ammonium compounds.

The same type of compounds can be independently used as antimicrobial agents for antimicrobial application onto a surface to be cleaned when they are present at high concentrations and for storage stability as preservatives of the composition at low concentrations.

Particularly suited for their antimicrobial activities are concentrations of the above compounds between about 0.04% and 10% of the composition.

On the other hand, particularly suited for their preservative activities are concentrations between about 0.01% and 10%.

In addition, the pH of the suspension may be adjusted to between about 7 and 11 by means of an organic acid or base as required.

The following process materials may be also present in the suspension in an amount between 0.01 and 10% by weight.

Suitable process materials within the confines of the invention are salts of inorganic acids and bases. Among these, preferred are those salts which may at the same time serve to adjust the pH of the composition as described hereinabove.

During the applying and drying steps, the liquid carrier along with the tensides and the low-molecular weight alcohols are placed in contact with the dirt, so that the dirt is loosened from the window surface and then returns to the sodium aluminum silicate in the final phase of the drying process. All the remaining components, that is, the dirt and the sodium aluminum silicates are deposited again onto the pulverized urea formaldehyde resin foam, as the carrier while the remaining volatile substances evaporate completely. What remains on the window surface is a milk-white powdery film containing the dirt which is strongly bound to the carrier material.

After the drying process, this dirt-laden white film can be removed with a dust-collection container by means of an air flow. Particularly useful for this purpose is a vacuum cleaner with a suitably shaped attachment.

To attain this kind of cleaning while at the same time assuring gentle treatment of the glass surfaces, a special cleaning suspension is necessary, which contains low-molecular alcohols and appropriate solids. The solids are a mixture, adapted to a cleaning agent, of sodium aluminum silicates and a urea formaldehyde resin foam, which when removed by suction functions as a carrier for the removed dirt and for the adhering and abrasive sodium aluminum silicates. The ability of the cleaning agent according to the invention to be removed by suction is assumed by this carrier effect.

One task of the special powdered solids in the cleaning agent is to perform an abrasive polishing of the surface to be cleaned. An additional task is to pick up the loosened dirt and make it available, in the dry state, for removal by suction. The abrasive polishing action of the powdered solids also impedes streaking that would result from residual dirt on the window pane.

It is understood that the foregoing description is that of the preferred embodiment of the invention and that various changes and modifications may be made thereto without departing from the spirit and scope of the invention as defined in the appended claims.

EXAMPLE

A suspension is prepared having the following composition. The ingredients are added in the stated order.

about 28.9% by weight of water, about 1.0% by weight of alkyl sulfonate, about 0.1% by weight of a fragrance, about 30.0% by weight of isopropanol, about 25.0% by weight of pulverized sodium aluminum silicate, about 5.0% by weight of a urea-formaldehyde foam, and about 10.0% by weight of a starch derivative with water added.

German patent application No. P 35 45 288.9, filed on Dec. 20, 1985 on which the claim of priority of this application is based is herewith incorporated by reference.

What is claimed is:

1. A liquid hard surfaces cleaning suspension for cleaning smooth hard surfaces, consisting essentially of:

from about 5 to 40% by weight of a sodium aluminum silicate having a particle size up to about and including 110μ;

from about 0.1 to 15% by weight of a pulverized urea-formaldehyde resin foam having a particle size up to about and including 110μ;

from about 2 to 50% by weight of a low-molecular weight alcohol;

from about 0.5 to 15% by weight of an anionic or non-ionic surfactant;

from about 10 to 60% by weight of water; and, from about 0.1 to 10% by weight of a thickener selected from the group consisting of polysaccharides and derivatives thereof.

2. The liquid cleaning suspension of claim 1, wherein the low-molecular weight alcohol is selected from the group consisting of linear and branched aliphatic, alicyclic and aromatic alcohols having 1 to 5 carbon atoms.

3. The liquid cleaning suspension of claim 2, wherein the low-molecular weight alcohol is isopropanol.

4. The liquid cleaning suspension of claim 1, wherein the anionic surfactants are selected from the group consisting of alkyl sulfonates.

5. The liquid cleaning suspension of claim 4, wherein the alkyl sulfonates are anionic lithium lauryl sulfonates.

6. The liquid cleaning suspension of claim 1, wherein the polysaccharide is starch; and, the starch derivatives are anionic starch derivatives.

7. The liquid cleaning suspension of claim 6, wherein the anionic starch derivatives are phosphate starch derivatives.

8. The liquid cleaning suspension of claim 1, further comprising from about 1 to 20% by weight of a volatile organic solvent.

9. The liquid cleaning suspension of claim 8, wherein the solvent is selected from the group consisting of hydrocarbons and derivatives thereof having oxygen, nitrogen or halogen substituents thereof.

10. The liquid cleaning suspension of claim 9, wherein the hydrocarbons are selected from the group of gasolines.

11. The liquid cleaning suspension of claim 8, wherein the organic solvent is acetone.

12. The liquid cleaning suspension of claim 8, wherein the halogenated hydrocarbons are selected from the group consisting of chlorinated hydrocarbons.

13. The liquid cleaning suspension of claim 1, having a pH between about 7 and 11.

14. The liquid cleaning suspension of claim 1, further comprising between about 0.01 and 5% by weight of a fragrance.

15. The liquid cleaning suspension of claim 1, further comprising between about 0.01 and 10% by weight of an antimicrobial or preservative agent.

16. The liquid cleaning suspension of claim 15, wherein the antimicrobial or preservative agent is selected from the group consisting of formaldehyde, compounds capable of generating formaldehyde in solution and quaternary ammonium compounds.

17. The liquid cleaning suspension of claim 1, further comprising between about 0.1 and 5% by weight of a process material selected from the group consisting of salts of inorganic acids and bases.

18. A method of cleaning a smooth hard surface, comprising the steps of:

applying to a soiled smooth hard surface an amount of a liquid cleaning suspension effective to cover the surface and the soil on the surface said cleaning suspension consisting essentially of:

from about 5 to 40% by weight of a sodium aluminum silicate having a particle size up to about and including 110μ;

from about 0.1 to 15% by weight of a pulverized urea-formaldehyde resin foam having a particle size up to about and including 110μ;

from about 2 to 50% by weight of a low-molecular weight alcohol;

from about 0.5 to 15% by weight of an anionic or non-ionic surfactant;

from about 10 to 60% by weight of water;

from about 0.1 to 10% by weight of a thickener selected from the group consisting of polysaccharides and derivatives thereof; and, the ratio of said water plus alcohol to said thickener being between about 12:0.1 and 11:1;

allowing for the liquid cleaning suspension to dry leaving on the surface a dry film; and, removing the dry film from the surface.

19. The process of claim 17, wherein the dry film is removed by means of an air flow.

20. The process of claim 19, wherein the dry film is removed by means of vacuum.

21. The process of claim 18, wherein conducting the drying step for a period of time effective for the sodium silicate to become bound to the formaldehyde urea foam and to the soil of the surface.

22. The process of claim 21, wherein the drying step is conducted for up to about and including 15 minutes.

23. A liquid hard surface cleaning suspension for cleaning smooth a hard surface, consisting essentially of:

from about 5 to 40% by weight of a sodium aluminum silicate having a particle size up to about and including 110μ;

from about 0.1 to 15% by weight of a pulverized urea-formaldehyde resin foam having a particle size up to about and including 110μ;

from about 2 to 50% by weight of a low-molecular weight alcohol;

from about 0.5 to 15% by weight of an anionic or non-ionic surfactant;

from about 10 to 60% by weight of water;

from about 0.1 to 10% by weight of a thickener selected from the group consisting of polysaccharides and derivatives thereof; and, the ratio of said water plus said alcohol to said thickener being between about 12:0.1 and 11:1.

24. The liquid cleaning suspension of claim 23, wherein, the ratio of said water to said alcohol plus organic solvent is between about 10:2 and 60:50.

25. The liquid hard surface cleaning suspension of claim 23, wherein said hard surface is an upwardly extending smooth glass surface.

26. The liquid hard surface cleaning suspension of claim 1, wherein the hard surface is an upwardly extending smooth glass surface.

27. The liquid hard surface cleaning suspension of claim 18, wherein the hard surface is an upwardly extending smooth glass surface.

* * * * *